United States Patent [19]

Shechter

[11] 4,443,992

[45] Apr. 24, 1984

[54] METHOD OF PREFABRICATED CONSTRUCTION, AND BUILDING STRUCTURE CONSTRUCTED IN ACCORDANCE WITH SUCH METHOD

[76] Inventor: Mordechai Shechter, Derech Haganim 43, Kfar Shmaryahu, Israel

[21] Appl. No.: 307,116

[22] Filed: Sep. 22, 1981

[30] Foreign Application Priority Data

Oct. 13, 1980 [IL] Israel ..... 61258

[51] Int. Cl.[3] ..... E04B 1/00

[52] U.S. Cl. ..... 52/745; 52/79.1; 52/506

[58] Field of Search ..... 52/79.1, 79.9, 79.12, 52/745, 234, 235, 243, 283, 483, 511, 506, 513

[56] References Cited

U.S. PATENT DOCUMENTS

| | | | |
|---|---|---|---|
| 3,008,550 | 11/1961 | Miles et al. | 52/283 X |
| 3,216,157 | 11/1965 | Pinter | 52/745 X |
| 3,540,177 | 11/1970 | Slining | 52/235 X |
| 4,065,905 | 1/1978 | Vanderlely | 52/79.1 X |

FOREIGN PATENT DOCUMENTS

| | | | |
|---|---|---|---|
| 2431606 | 1/1976 | Fed. Rep. of Germany | 52/79.1 |

*Primary Examiner*—Carl D. Friedman

*Attorney, Agent, or Firm*—Benjamin J. Barish

[57] ABSTRACT

A method of construction by the use of prefabricated building units is described in which an open three-dimensional steel cage of relatively light structure is constructed off-site according to the desired specific configuration of the building unit; pre-cast concrete wall panels are attached to the sides of the steel cage by welding metal rings embedded within openings in the pre-cast concrete panels to laterally-projecting metal rings welded to the steel cage, to form the walls of the building unit and to add strength and rigidity to the building unit; the building unit is completed with a floor and roof further adding strength and rigidity to it; and the completed building unit is then transferred to a suitably prepared foundation at the construction site.

8 Claims, 4 Drawing Figures

METHOD OF PREFABRICATED CONSTRUCTION, AND BUILDING STRUCTURE CONSTRUCTED IN ACCORDANCE WITH SUCH METHOD

BACKGROUND OF THE INVENTION

The present invention relates to a method of prefabricated building construction, and also to a building structure constructed in accordance with the novel method.

The many advantages of prefabricated building construction are well known, including greater susceptibility to massproduction techniques, better quality control, less skilled personnel required and more efficient use of skilled personnel, and less sensitivity to adverse weather conditions at the construction site. Many prefabricated building construction systems have therefore been developed and are now in use. However, one of the main disadvantages of the known prefabricated building construction systems is the relatively low degree of permissible design flexibility since the known systems usually require the use of molds. This, as a practical matter, drastically limits the number of designs which are economically feasible.

An object of the present invention is to provide a new method of building construction by the use of prefabricated building units which new method has the advantage, among others to be described below, of permitting a high degree of design flexibility. Another object of the invention is to provide a building structure constructed in accordance with the novel method.

BRIEF SUMMARY OF THE INVENTION

According to a broad aspect of the present invention, there is provided a method of building construction by the use of prefabricated building units, characterized in that an open three-dimensional steel cage of steel profile members is constructed according to the desired specific configuration of the building unit; pre-case concrete wall panels are attached to the sides of said steel cage by welding metal rings embedded within openings in the pre-cast concrete panels to laterally-projecting metal rings welded to the steel cage, to form the walls of the building unit and to add strength and rigidity to the building unit; and the building unit is completed with a floor and roof further adding strength and rigidity to it. The foregoing operations are performed off-site, and the completed building unit is then transferred to a suitably prepared foundation at the construction site.

As will be described more particularly below, such a method provides a number of important advantages over and above the usual advantages of prefabricated building constructions. Thus, one important advantage is that the steel cage may be constructed according to any desired configuration, which inherently provides a high degree of design flexibility in the building units to be produced. Thus, the building unit may be constructed to include any desired number of rooms, according to any desired configuration and layout. Another important advantage is that the novel method enables the constructed steel cage to be of a relatively light structure because its strength and rigidity is enhanced by the pre-cast concrete wall panels attached to it. Thus, the steel cage may be constructed of relatively lightweight steel profile members and does not require diagonal bracing. A further important advantage is that the construction system enables better thermal insulation to be obtained in that it avoids concrete-to-concrete heat bridges between the interior and exterior concrete wall panels, since these panels may be separated either by thermal insulation applied between them or by the relatively thin steel profile members of the steel cage.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
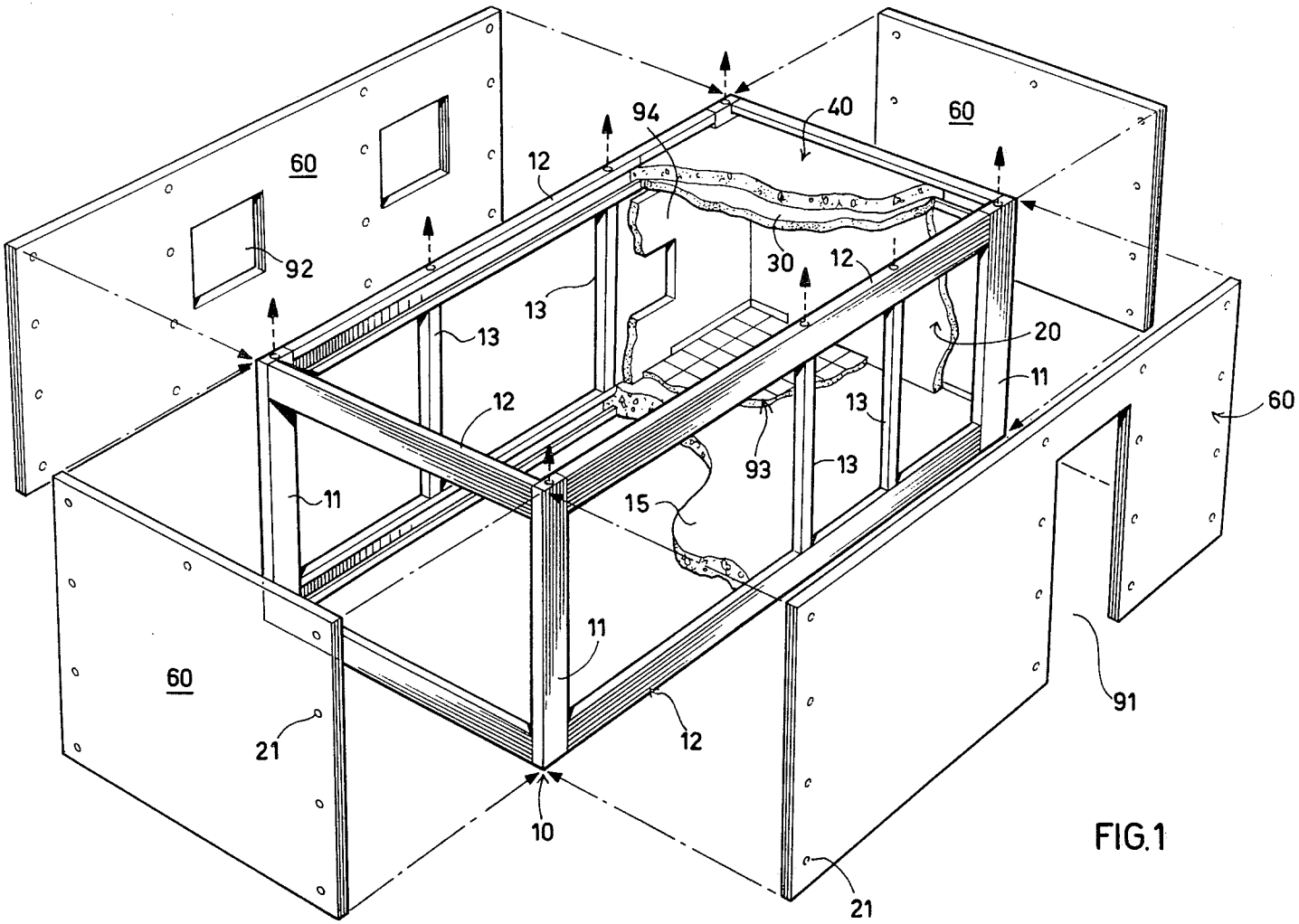
FIG. 1 is an exploded three-dimensional view illustrating one example of a building unit constructed in accordance with the invention.

The building unit described herein, for purposes of example, is constructed off-site (i.e., at a manufacturing site remotely located from the building site) in the following manner;

First, a three-dimensional steel cage, generally designated 10 in FIG. 1, is constructed according to the desired specific configuration of the respective building unit; in the example illustrated, the building unit is to be a one-room unit of rectangular configuration including a door in one wall and a pair of windows in the opposite wall, but it will be appreciated that the building unit could be of almost any desired configuration, size and room layout.

The open three-dimensional steel cage 10 is constructed of steel profile members to form four corner vertical columns 11 and eight horizontal beams 12 all welded together to form a rigid cage. In this case, the single-room building unit is relatively long, and therefore the case also includes a pair of intermediate vertical columns 13 along each longitudinal wall to be formed for supporting the beams and the concrete wall panels to be subsequently applied.

Figure 2:
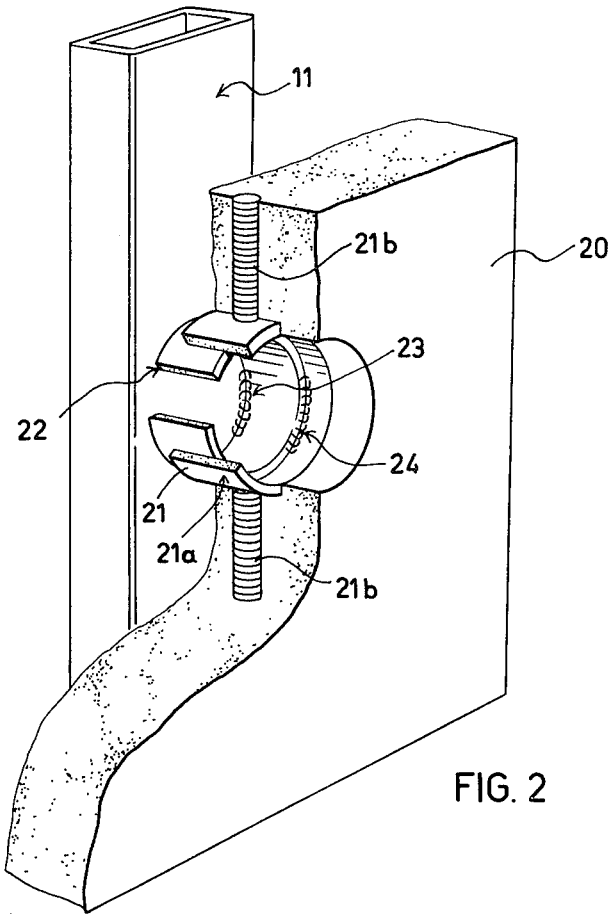
FIG. 2 is a fragmentary three-dimensional view illustrating the main method of attaching the pre-cast concrete wall panels to the steel cage in the building unit of FIG. 1.
Figure 3:
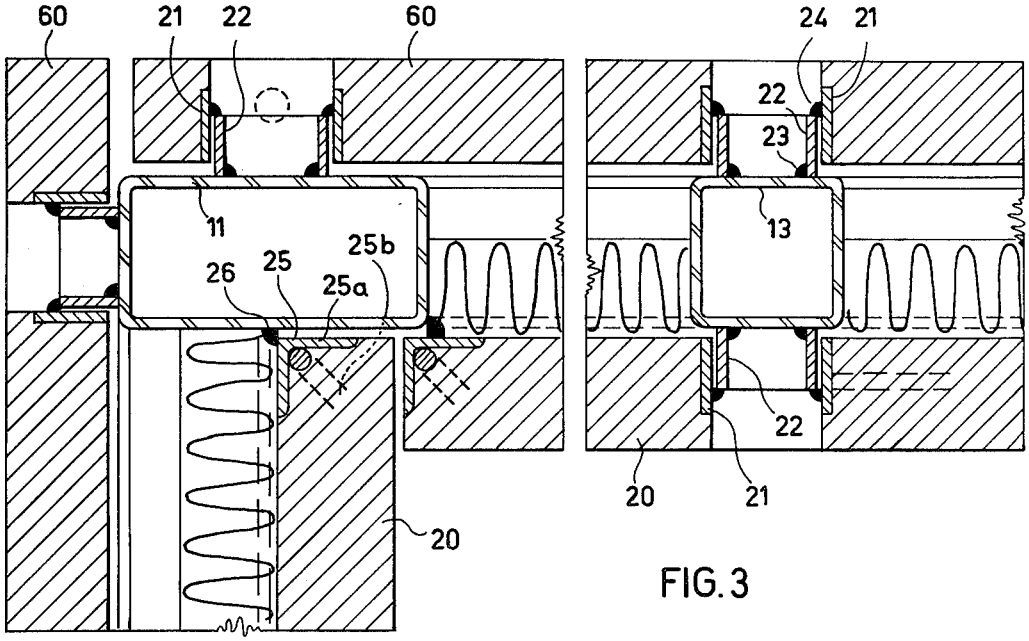
FIG. 3 is a longitudinal sectional view through the completed building unit of FIG. 1, illustrating the method of attaching both the exterior and the interior concrete wall panels to the steel cage.

FIGS. 2 and 3 illustrate the configuration of the vertical columns 11 and 13 of the steel cage 10, wherein it will be seen that these members are of rectangular configuration. However, as shown particularly in FIG. 3, the corner columns 11 have a cross-sectional width greater than their cross-sectional height, whereas the intermediate columns 13 have a cross-sectional width equal to their cross-sectional height. The configuration of the horizontal beams 12 is more particularly illustrated in FIG. 4, wherein it will be seen that they are of C-shaped section. While these configurations of the members 11, 12 and 13 of the steel cage 10 have been found particularly advantageous in the example illustrated in the drawings, it will be appreciated that these members can take many other configurations according to the requirements of each application.

Figure 4:
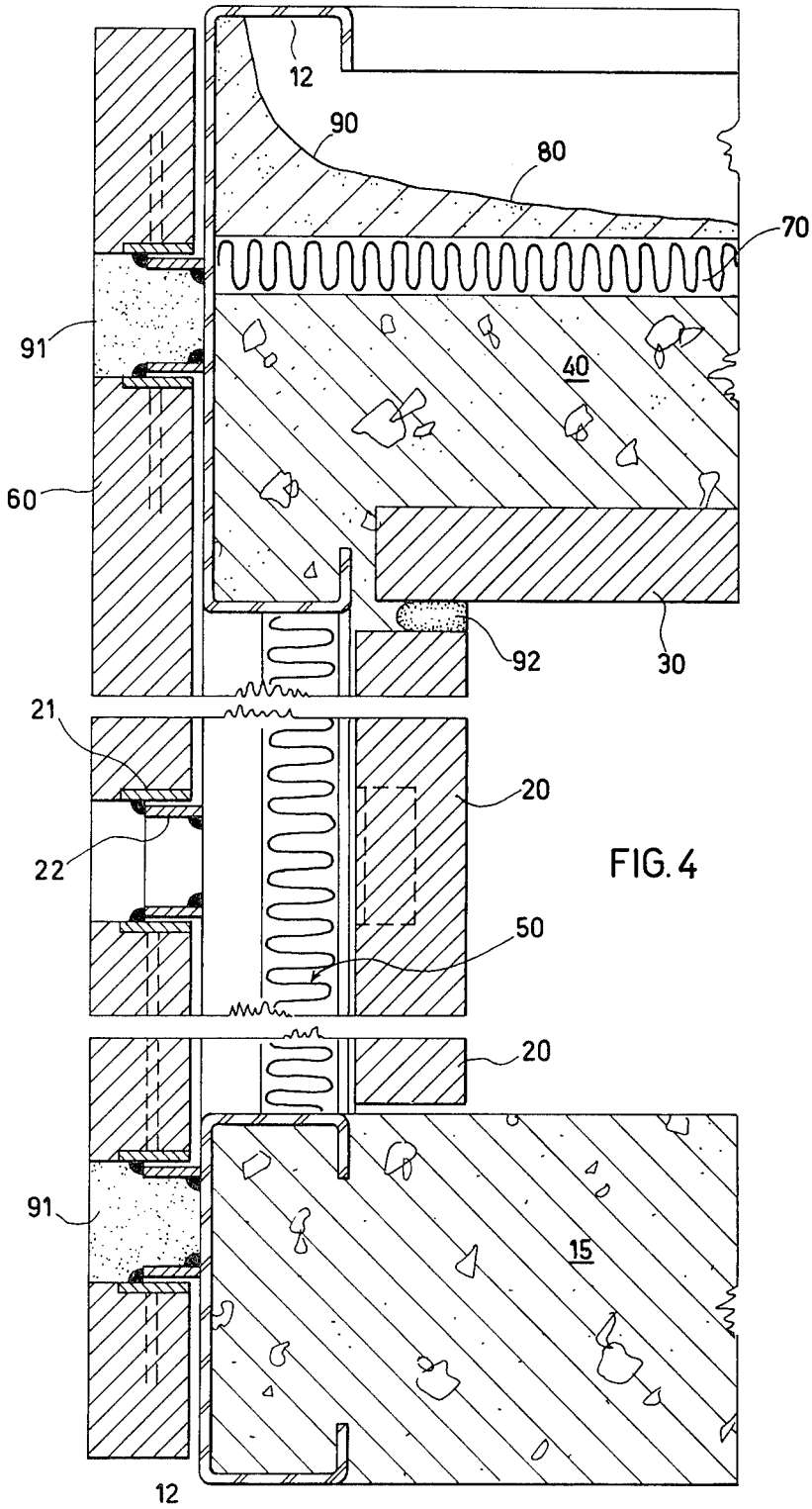
FIG. 4 is a sectional view through a corner vertical column of the completed building unit of FIG. 1 and particularly illustrating the method of forming the floor and roof of the building unit.

After the steel cage 10 has been constructed, the normal sewage and water supply pipes (not shown) are disposed within it, and then a layer of concrete, as shown at 15 in FIG. 4, is cast to form the floor of the building unit, this layer of concrete embedding the above pipes and also the lower end of the steel cage 10. The C-section of the lower horizontal beams 12, as illustrated in FIG. 4, provides secure anchoring of the steel cage to the cast concrete floor 15.

The interior concrete wall panels 20 are then attached to the steel cage 10 by means of metal inserts 21 embedded within openings formed in the concrete panels when cast. Such inserts are best illustrated in FIG. 2, wherein it will be seen that each includes a ring member 21*a* which is embedded in the concrete panels 20, and anchor members 21*b* (e.g., on three sides) for more securely holding these ring members in place. The anchor members 21*b* are embedded in the concrete panels along their outer margins so as to be alignable with the steel profile members of cage 10. Each panel 20 is attached to the steel cage by inserting another ring 22, of slightly smaller diameter than ring 21*a* of the embedded insert 21, within each of the rings 21*a*. Each inner ring 22 is then welded to its respective cage member as shown at 23, and to the outer ring 21*a* as shown at 24.

At the corners, the interior concrete wall panels 20 may include another type of metal insert as shown at 25 in FIG. 3, each of which includes a metal corner member 25*a* embedded within the corner of panel 20, firmly anchored therein by anchor members 25*b* extending from its opposite ends. Corner members 25 are welded directly to the steel cage as shown at 26.

After the interior concrete wall panels 20 have been mounted, a pre-cast ceiling panel 30 is applied to rest on top of the interior wall panels. Ceiling panel 30 is relatively thin and serves both as a supporting surface for the water and electricity conduits (not shown) to be fixed within the ceiling, and also as a permanent shuttering for the relatively thicker concrete roof 40 to be cast thereover. The concrete roof 40 may now be cast over the ceiling panel 30 and is preferably of a substantially greater thickness than the ceiling panel; for example, the ceiling panel 30 may be about 4 cm in thickness, and the cast concrete layer 40 may be about 8 cm in thickness.

The wall-mounted water and electrical conduits (not shown) would be mounted on the interior concrete wall panels 20 at the same time as the ceiling conduits are applied, i.e., before the roof is cast. The wall insulation 50 may be applied before or after the roof is cast. This insulation may be, e.g., polystyrene, and it may be applied by gluing it to the outer faces of the interior concrete wall panels 20.

The exterior concrete wall panels 60 are then applied. These are attached to the steel cage 10 by means of the same type of metal inserts 21 and 22 as illustrated in FIG. 2 and as described above.

After the exterior wall panels 60 have been mounted, the roof may then be finished by applying a layer of insulation 70, e.g., polystyrene, then casting a layer 80 of light-weight concrete at a slope, and then applying a felt and bitumen weathering layer 90. The building unit may now be finished by applying the door frame and door in opening 91 (FIG. 1), windows in openings 92, flooring 93, plastering 94, painting, and the like, both internally and externally of the building unit. In finishing the building unit, the securing rings 21, 22 may be filled with plaster or cement plugs, as shown at 91 in FIG. 4. Also, any spaces formed by the unevenness of contacting surfaces, for example between the upper faces of the interior concrete wall panels 20 and the lower faces of the pre-cast concrete ceiling 30, may be filled with plaster strips or plugs as shown at 92 in FIG. 4.

The completed building unit can now be transferred in any suitable manner to a suitably prepared foundation at the building site.

The building unit constructed as described above provides a number of important advantages over other known prefabricated building systems. Thus, since its basic design is determined by the steel cage 10, and not by previously-made molds or shutterings, a high degree of design flexibility is provided with respect to the size of the building unit, its configuration, the number of rooms, and the room-layouts. Further, the steel cage 10 may be of a relatively light structure, made of thin profile members and without any diagonal bracing since its strength and rigidity are substantially enhanced by the pre-cast concrete wall panels attached to the steel cage, as well as by the concrete floor and roof applied to it before the building unit is transferred to the building site. Permitting the use of a relatively light steel cage structure not only decreases the manufacturing cost, but also simplifies the handling of the unit during its construction and during its transfer to the building site. A still further advantage provided by the building unit constructed as described above is that it enables better thermal insulation to be obtained, since it avoids concrete-to-concrete heat bridges between the interior and exterior concrete wall panels which are separated mostly by thermal insulation, and in the remaining places by the thin profile members of the steel cage.

The described building unit may constitute the complete building structure. On the other hand, the complete building structure may include a plurality of such building units laid side by side and/or on top of each other, according to the specific design desired.

While the invention has been described with respect to one preferred embodiment, it will be appreciated that many variations and modifications may be made. For example, the steel cage 10 may be constructed according to any design, configuration and room layout desired for any particular case, as indicated above. Also, the members 11, 12 and 13 of the steel cage 10 may be of any suitable section. Further, instead of using a single wall panel (e.g., 20 or 60) for each wall, the wall may (and preferably would in many cases) be constituted of a plurality of separate panels; for example, to accommodate doors, and the like. Also, the wall panels may be welded to the steel cage 10 by the use of other configurations of inserts, or may be secured to the steel cage in manners other than welding, for example, by nuts and bolts.

Many other variations, modifications and applications of the illustrated embodiment will be apparent.

What is claimed is:

1. A method of construction by the use of prefabricated building units, characterized in that an open three-dimensional steel cage of steel profile members is constructed according to the desired specific configuration of the building unit; pre-cast concrete wall panels are attached to the sides of said steel cage, by welding metal rings embedded within openings in the pre-cast concrete panels to laterally-projecting metal rings welded to the steel cage, to form the walls of the building unit and to add strength and rigidity to the building unit; and the building unit is completed with a floor and roof further adding strength and rigidity to it.

2. The method according to claim 1, further characterized in that said steel cage is constructed off-site, the pre-cast concrete wall panels being attached and the building unit being completed with the floor and roof also off-site, following which the completed building unit is transferred to a suitably prepared foundation at the construction site.

3. The method according to claim 1, further characterized in that said pre-cast concrete wall panels attached to the steel cage include interior and exterior panels with insulation in between.

4. The method according to claim 3, further characterized in that the roof of the building unit is applied after the interior concrete panels are attached, by laying a pre-cast concrete ceiling panel over the top of the interior concrete wall panels, and casting a concrete roof thereover embedding the ceiling panel and the top of the steel cage.

5. The method according to claim 4, further characterized in that the ceiling water and electrical conduits are applied to the pre-cast ceiling panel before the concrete roof is cast thereover, whereby the pre-cast ceiling panel serves both as a support for the conduits and a permanent shuttering for the concrete roof.

6. The method according to claim 1, further characterized in that the floor of the building unit is applied by laying the sewage and water supply pipes within the lower end of the cage and casting concrete thereover to cover the pipes and the lower end of the cage.

7. The method according to claim 1, further characterized in that said concrete wall panels further include metal angle members embedded at the corners thereof, which angle members are also welded to the steel cage.

8. The method according to claim 1, further characterized in that said steel cage includes vertical column members of rectangular section and horizontal beam members of C-section all welded together to form the cage of the desired specific configuration of the building unit.

* * * * *